US006089668A

United States Patent [19]

Peterson

[11] Patent Number: 6,089,668

[45] Date of Patent: Jul. 18, 2000

[54] AIR CUSHIONED FURNITURE

[75] Inventor: Leroy L. Peterson, Omaha, Nebr.

[73] Assignee: Sportsstuff, Inc., Omaha, Nebr.

[21] Appl. No.: 09/306,505

[22] Filed: May 6, 1999

[51] Int. Cl.[7] ..... A47C 7/02

[52] U.S. Cl. ..... 297/452.41; 297/DIG. 3; 297/423.41; 5/654

[58] Field of Search ..... 297/DIG. 3, 452.41, 297/423.39, 423.41; 5/655, 655.3, 710, 654, 653

[56] References Cited

U.S. PATENT DOCUMENTS

| | | | |
|---|---|---|---|
| 3,029,109 | 4/1962 | Nail | 297/DIG. 3 |
| 3,125,377 | 3/1964 | Bridges | 297/DIG. 3 |
| 3,572,836 | 3/1971 | Khanh . | |
| 3,584,914 | 6/1971 | Williams . | |
| 4,099,773 | 7/1978 | Chang . | |
| 4,153,958 | 5/1979 | Paulik . | |
| 4,547,919 | 10/1985 | Wang | 297/DIG. 3 X |
| 4,905,332 | 3/1990 | Wang | 5/655.3 |
| 5,003,653 | 4/1991 | Mar | 297/DIG. 3 X |

*Primary Examiner*—Anthony D. Barfield
*Attorney, Agent, or Firm*—Henderson & Sturm LLP

[57] ABSTRACT

Air cushioned furniture including an inflatable support ring and a separately inflatable insert that is matingly received in the central cavity of the support ring. This support ring and insert combination provides a stable article of furniture that will adequately support the weight of the user. The air cushioned article of furniture may be used, for example, as a footstool, chair, loveseat, or couch suitable for indoor or outdoor use. Both the support ring and the insert may be covered with a shell of various fabrics that would be compatible with any desired decor.

13 Claims, 2 Drawing Sheets

AIR CUSHIONED FURNITURE

CROSS REFERENCE TO RELATED APPLICATIONS

Not applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

The present invention relates to the field of inflatables, and more particularly to air cushioned furniture for indoor or outdoor use.

2. Description of Related Art

As can be seen by reference to the following U.S. Pat. Nos. 3,572,836; 3,584,914; 4,099,773; and 4,153,958, the prior art is replete with myriad and diverse articles of inflatable furniture.

All of the aforementioned prior art constructions are generally inadequate for the basic purpose and function, as a stable article of furniture. They are uniformly deficient with respect to their failure to provide a simple, efficient, and practical stable piece of furniture for indoor or outdoor use.

As a consequence of the foregoing situation, there has existed a longstanding need for a new and improved type of air cushioned furniture, and the provision of such a construction is a stated objective of the present invention.

BRIEF SUMMARY OF THE INVENTION

Briefly stated, the present invention provides air cushioned furniture including an inflatable support ring and a separately inflatable insert that is matingly received in the central cavity of the support ring. This support ring and insert combination provides a stable article of furniture that will adequately support the weight of the user. The air cushioned article of furniture may be used, for example, as a footstool, chair, loveseat, or couch suitable for indoor or outdoor use. Both the support ring and the insert may be covered with a shell of various fabrics that would be compatible with any desired decor.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
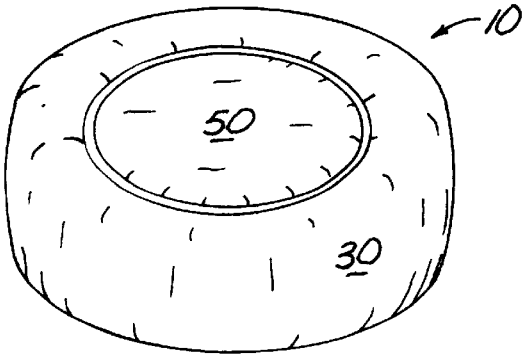
FIG. 1 is a perspective view of an air cushioned footstool with a fabric shell.
Figure 2:
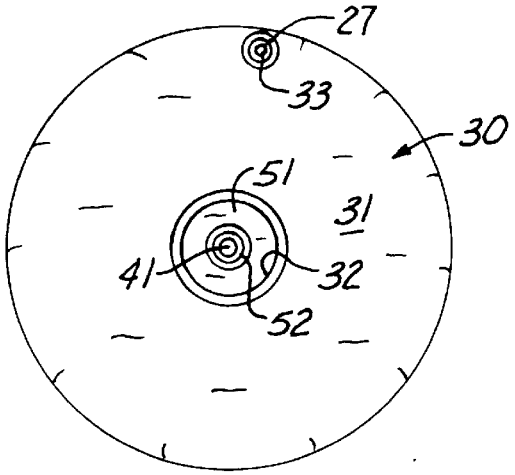
FIG. 2 is a bottom plan view thereof.
Figure 3:
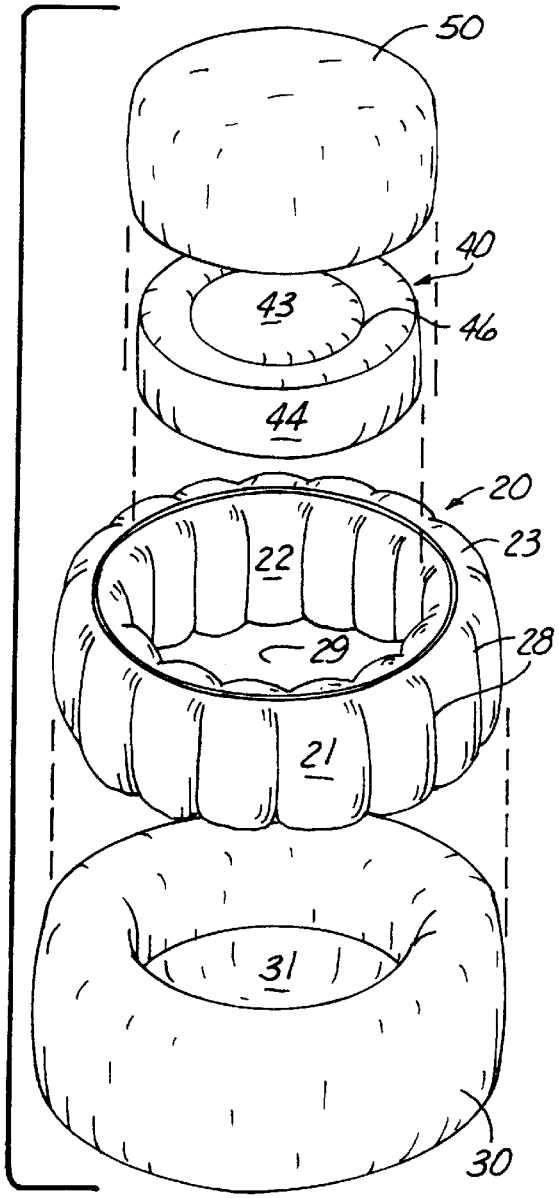
FIG. 3 is an exploded perspective view illustrating the components of the air cushioned footstool.

As can be seen by reference to the drawings, and in particular to FIG. 1, the air cushioned footstool that forms the basis of the present invention is designated generally by the reference number 10. The footstool 10 includes an inflatable peripheral support ring 20 and a separate inflatable insert 40. As best shown in the lower portions of FIGS. 3 and 4, the support ring 20 is covered by a fabric shell 30 and the insert is covered by a fabric shell 50.

The support ring 20 has an outer vertical sidewall 21, an inner vertical sidewall 22, a top surface 23, a bottom support surface 24, and an internal radially disposed vertical support web 25. A space 26 is left in the top and bottom of the support web 25 so that a ring inflation valve 27 is in fluid communication with the internal chamber formed by the sidewalls 21, 22. Indentations 28 occur in the sidewalls 21, 22 at the positions where the support web 25 is attached to the interior surface of the sidewalls 21, 22. A central open cavity 29 is defined by the inner sidewall 22.

Figure 4:
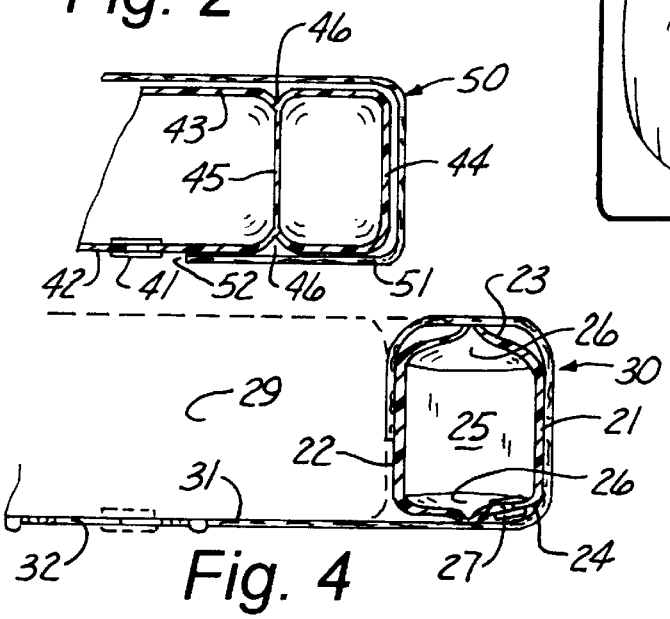
FIG. 4 is a partial sectional view illustrating the fabric covered insert positioned to be received into the central cavity of the fabric covered support ring.
Figure 5:
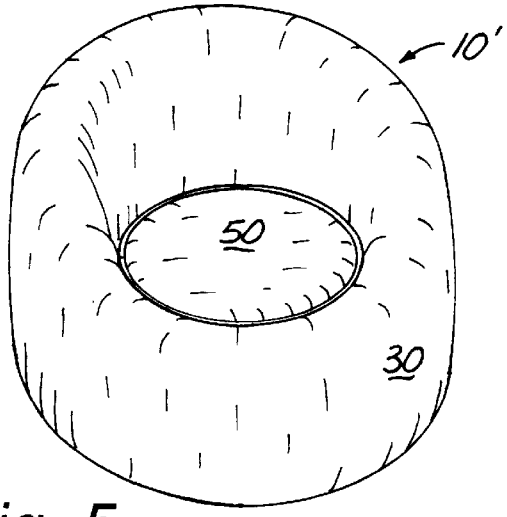
FIG. 5 is a perspective view of an air-cushioned chair with a fabric shell.
Figure 6:
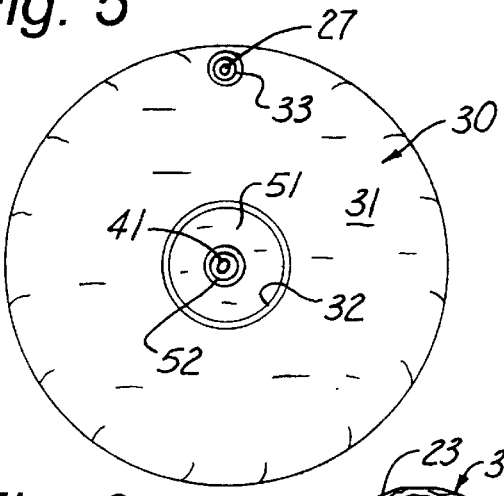
FIG. 6 is a bottom plan view thereof.
Figure 8:
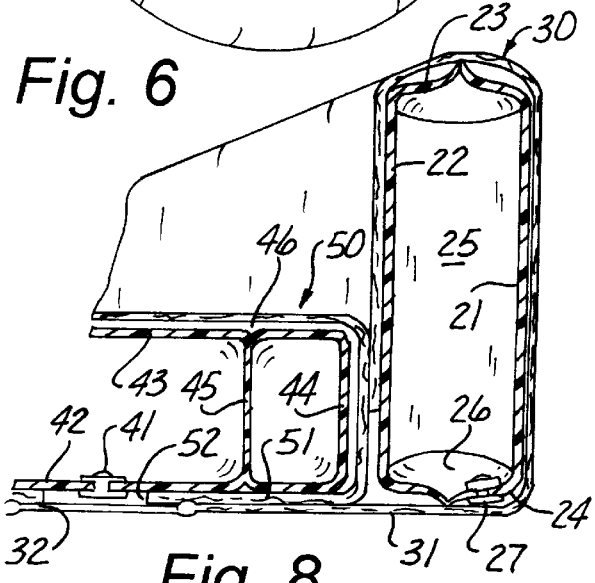
FIG. 8 is a partial sectional view illustrating the fabric covered insert matingly received in the central cavity of the fabric covered support ring.
Figure 7:
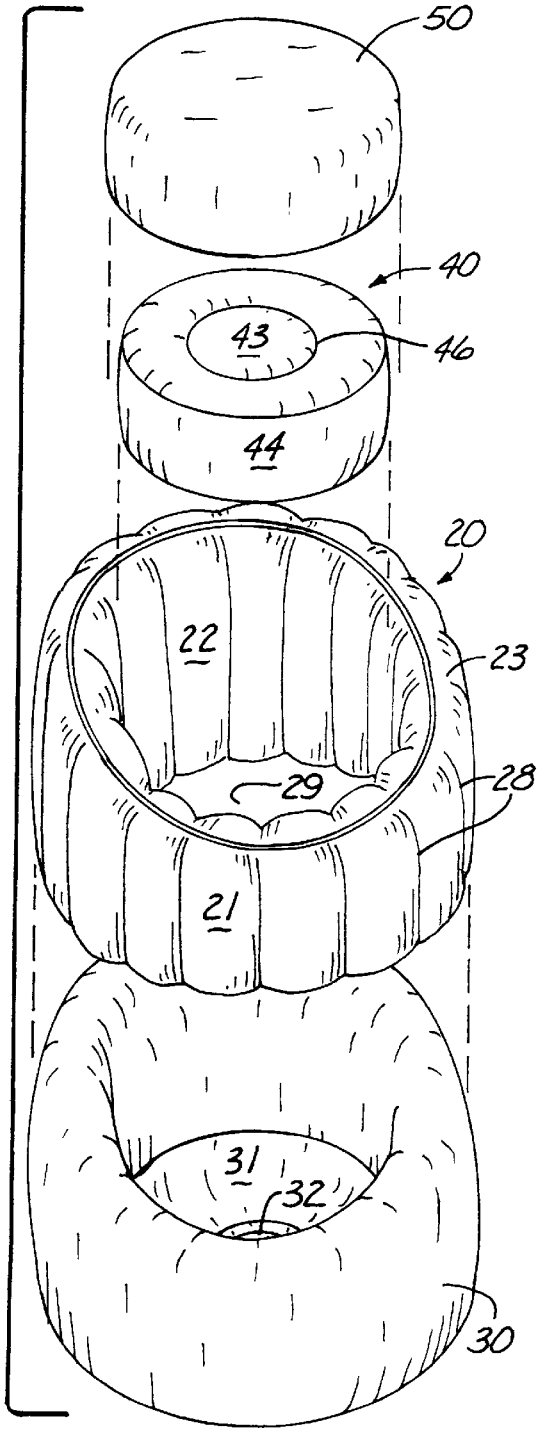
FIG. 7 is an exploded perspective view illustrating the components of the air cushioned chair.

The ring support shell 30 surrounds the support ring 20 as illustrated in the lower portion of FIG. 4. The shell 30 includes a bottom panel 31 with inflation valve access openings 32 and 33. The bottom panel 31 extends across the bottom of the central cavity 29 and across the bottom support surface 24 of the ring 20. The remainder of the shell 30 covers the outer sidewall 21, the top surface 23, and a portion of the inner sidewall 22 of the ring 20.

The inflatable insert 40 includes a separate inflation valve 41 formed in a lower support surface 42 of the insert 40. The upper surface 43 and lower surface 42 are joined by vertical sidewall 44.

An aperatured internal reinforcing web 45 is attached to the interior of the upper and lower surfaces 42, 43 and is disposed concentrically to the sidewall 44. An indentation 46 occurs in the upper and lower surfaces 42, 43 where the reinforcing web 45 is attached.

The insert shell 50 surrounds the insert 40 as illustrated in the upper portion of FIG. 4. The shell 50 includes a bottom panel 51 with an inflation valve access opening 52. The shell 50 completely covers the insert 40 except for the small area of the access opening 52.

In use, the deflated support ring 20 is positioned in the shell 30 such that the inflation valve 27 of the ring 20 is aligned with the access opening 33 in the bottom panel 31 of the shell 30. The support ring 20 is then fully inflated so that it snugly fits within the shell 30 with the bottom panel 31 stretched tightly across the bottom of the central cavity 29. The deflated insert 40 is then inserted into the fabric shell 50 through the access opening 52 and fully inflated. The covered insert 40 is then inserted into the central cavity of the ring 20 so that the lower support surface 42 of the insert is substantially horizontally aligned with the bottom support surface 24 of the ring 20 by contact with the bottom panel 31 of the support ring shell 30. In this position, the upper surface 43 of the insert 40 is also substantially horizontally aligned with the top surface 23 of the ring 20. Since the insert 40 is matingly received within the central cavity 29 of the peripheral support ring 20, the resulting footstool 10 is very stable and not easily deformed when bearing the weight of a person.

FIGS. 5–8 illustrate a chair 10' that is structurally similar to the footstool 10 illustrated in FIGS. 1–4. The only difference is that the support ring 20 has a top surface 23 that is inclined from horizontal and extends above the horizontal level of the insert 40 to form a raised chair back and side arms. As with the footstool 10, the chair 10' is very stable and not easily deformed.

Other articles of furniture such as loveseats, couches, and beds could also be fashioned using this basic structure of an inflatable insert 40. It is also to be understood that the furniture could be configured without the shells 30, 50 and that the shells could be made of any fabric compatible with the desired decor.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. Air cushioned furniture, comprising:

an inflatable peripheral support ring having a ring inflation valve and including an outer vertical sidewall, an inner vertical sidewall, a top surface joining a top portion of the outer and inner sidewalls, a bottom support surface joining a bottom portion of the outer and inner sidewall, and a central cavity defined by the inner sidewall;

a removable inflatable insert disposed to be matingly received within the central cavity, the insert having an insert inflation valve and including a lower support surface disposed in horizontal alignment with the bottom support surface of the ring, and upper surface disposed in horizontal alignment with a portion of the top surface of the ring; and a ring support shell dimensioned to surround the peripheral ring and includes a bottom panel disposed to underlie the bottom support surface of the ring, and to underlie the lower support surface of the insert.

2. The air cushioned furniture of claim 1 wherein the peripheral ring is circular.

3. The air cushioned furniture of claim 2 wherein the top surface of the ring is horizontally disposed.

4. The air cushioned furniture of claim 3 wherein the peripheral ring includes a plurality of vertical support webs interconnecting the outer and inner vertical sidewalls.

5. The air cushioned furniture of claim 2 wherein the top surface of the ring is inclined from horizontal.

6. The air cushioned furniture of claim 5 wherein the peripheral ring includes a plurality of vertical support webs interconnecting the outer and inner vertical sidewalls.

7. The air cushioned furniture of claim 2 wherein the peripheral ring includes a plurality of vertical support webs interconnecting the outer and inner vertical sidewalls.

8. The air cushioned furniture of claim 1 wherein the top surface of the ring is horizontally disposed.

9. The air cushioned furniture of claim 8 wherein the peripheral ring includes a plurality of vertical support webs interconnecting the outer and inner vertical sidewalls.

10. The air cushioned furniture of claim 1 wherein the top surface of the ring is inclined from horizontal.

11. The air cushioned furniture of claim 10 wherein the peripheral ring includes a plurality of vertical support webs interconnecting the outer and inner vertical sidewalls.

12. The air cushioned furniture of claim 1 wherein the peripheral ring includes a plurality of vertical support webs interconnecting the outer and inner vertical sidewalls.

13. The air cushioned furniture of claim 1 wherein an insert shell is disposed to surround the insert.

* * * * *